US005950831A

United States Patent [19]

Millet

[11] Patent Number: 5,950,831

[45] Date of Patent: Sep. 14, 1999

[54] HOLDER FOR A BOTTLED BEVERAGE

[75] Inventor: Stéphane Millet, Paris, France

[73] Assignee: Garcon! Brands Limited, Cork, Ireland

[21] Appl. No.: 08/777,884

[22] Filed: Dec. 31, 1996

[51] Int. Cl.[6] ..... B65D 85/00

[52] U.S. Cl. ..... 206/446; 206/779; 229/108

[58] Field of Search ..... 206/139, 145, 206/147, 149, 162, 194, 196, 199, 427–435, 446, 779, 782; 211/74; 229/103.2, 103.3, 108, 117.13, 117.14, 117.16, 120, 120.1, 198.2, 89–91; 294/87.2, 99.1, 137

[56] References Cited

U.S. PATENT DOCUMENTS

| | | | |
|---|---|---|---|
| 2,103,373 | 12/1937 | McClure | 229/120 |
| 2,173,494 | 9/1939 | Rous | 229/117.14 |
| 2,325,224 | 7/1943 | Bryant, Sr. | 206/446 |
| 2,339,176 | 1/1944 | Lee | 206/433 |
| 3,432,061 | 3/1969 | Anderson | 229/198.2 |
| 3,744,707 | 7/1973 | Ross | 229/198.2 |
| 3,866,821 | 2/1975 | Schaerf | 229/117.14 |
| 3,884,410 | 5/1975 | Giesecke | 229/198.2 |
| 4,105,155 | 8/1978 | Forbas, Jr. | 229/112 |
| 5,462,220 | 10/1995 | Bacchetti et al. | 229/112 |
| 5,624,043 | 4/1997 | Baptista | 221/74 |

FOREIGN PATENT DOCUMENTS

| | | | |
|---|---|---|---|
| 0029365 | 5/1981 | European Pat. Off. | 206/434 |
| 1456905 | 9/1966 | France | 206/433 |

*Primary Examiner*—Jim Foster

*Attorney, Agent, or Firm*—Sterne, Kessler, Goldstein & Fox P.L.L.C.

[57] ABSTRACT

The present invention is a holder for a bottled beverage which is constructed from a cardboard blank. The blank defines a plurality of panels which are folded and locked together to form an interior for receiving a bottled beverage. The holder may be decorated or personalized for presentation as a gift.

15 Claims, 6 Drawing Sheets

HOLDER FOR A BOTTLED BEVERAGE

BACKGROUND OF THE INVENTION

1. Field of the Invention

The present invention is generally directed to a holder for a bottle. More particularly, the present invention is a holder for a bottled beverage such as wine.

2. Related Art

Practically every meal is served with a beverage. Bottled beverages, especially wines, are frequently brought to the table to refill a glass without disrupting the meal. White wines and champagnes are typically chilled and served in a wine bucket to maintain the wine at a desired temperature. The wine bucket may be set on the table per se or positioned within a stand located near the table. While a wine bucket maintains the wine at a desired temperature, the bucket can be space-consuming regardless of its position on or near the table. In addition, the bucket chilling method can be "messy" as partially melted ice can fall out of the bucket as the bottle is withdrawn from the bucket throughout the meal.

Red and white wines are sometimes transferred from their original bottles to carafes for presentation at the table. A carafe is provided with a flared lip to prevent drops of wine from running down the neck of the bottle as wine is poured from the carafe into the glass. Although a carafe prevents drops of wine from reaching the table, it is not capable of maintaining the wine at a desired serving temperature. Other means for preventing drops of wine from staining the surface of a table include wine trivets or coasters. Wine coasters are typically formed as shallow metal containers having cork inserts or bottoms. Like wine carafes, wine coasters do not maintain the wine at a desired temperature.

A bottle of wine is an excellent gift for a friend or business associate. However, many wines are not sold in packages or boxes which are suitable for wrapping with a decorative paper. Therefore, wines are often presented as gifts by tying bows or ribbons about the neck of the bottle. Decorative paper bags are also known for presenting a bottle of wine as a gift. The bags are dimensioned to receive a single bottle of wine and include a handle and a gift tag at the top of the bag. The bags may be colored or printed with a festive design. Fabric sleeves are also known for presenting a bottle a wine. The sleeve may be provided with a tie for drawing the upper portion of the sleeve about the neck of a bottle. While gift bags and fabric sleeves offer a decorative means for presenting a bottle of wine, the wine must be removed from the bag or sleeve in order to examine, chill or serve the wine. Furthermore, many people prefer to decorate their own packages in order to personalize the gift for the intended recipient.

The holder of the present invention was designed with the above described disadvantages in mind. It is an objective of the present invention to provide a holder for a bottled beverage (for example, wine) which is easy to manufacture and assemble.

Another objective of the invention is to provide a holder for a bottled beverage which functions as a decorative package for presenting the bottled beverage as a gift. A further objective of the invention is to provide a holder for a bottled beverage which may be decorated by the consumer or personalized for presentation as a gift to a business associate.

Yet another objective of the invention is to provide a holder for serving a bottled beverage.

Still another objective of the invention is to provide a holder for a bottled beverage which maintains the beverage at a desired serving temperature.

Another objective of the invention is to provide a holder for a bottled beverage which absorbs spills or drops as the beverage is poured from the holder into a glass.

Another objective of the invention is to provide a holder for a bottled beverage which is lightweight and easy to manipulate.

Still another objective of the invention is to provide a holder for a bottled beverage which protects the beverage from damage due to exposure to light.

Yet another objective of the present invention is to provide a holder for a bottle of wine which maintains the wine bottle in an inclined position for oxygenation. The inclined position of the bottle allows one to serve the wine with as few jerks as possible, while keeping the wine still and more free of suspended particles.

Still another objective of the invention is to provide a holder for a wine bottle for use in "blind taste-testings" and then subsequently revealing the label by punching out a "window" of the holder.

SUMMARY OF THE INVENTION

It was with the foregoing objectives in mind that the present invention was developed. In one aspect, the present invention is a holder for a bottled beverage comprising a one-piece blank. The blank comprises a bottom panel, a left side panel, a right side panel, a front panel, and a rear panel. The front panel includes a means for receiving the neck of a bottled beverage. The front panel is arranged at an angle with respect to the bottom panel so that the bottled beverage is maintained within the holder in an inclined position. The means for receiving the neck of a bottle may comprise a circular aperture. The holder may be cut from a blank which is formed from a sheet of material having insulating properties. The blank may be formed from cardboard. The blank may include a means for maintaining the holder in an assembled condition. The means for maintaining the holder in an assembled condition may comprise tabs and slots. The front panel is arranged at an angle of 90° or less with respect to the bottom panel.

In another aspect, the present invention is a holder for a bottled beverage comprising a means for maintaining the bottle in an inclined position. The means may comprise a first side panel having an aperture for receiving the neck of a bottled beverage. A bottom panel may be attached to the first side panel at a first location. The first side panel may be oriented at an angle of 90° or less with respect to the bottom panel.

In yet another aspect of the invention, a holder for a bottled beverage is provided having a bottom panel, a front panel, a rear panel, a left side panel, and a right side panel. The front panel includes an aperture for receiving the neck of a bottled beverage. The front panel is arranged at an angle with respect to the bottom panel of the holder to maintain the bottled beverage in an inclined position.

BRIEF DESCRIPTION OF THE FIGURES

The accompanying drawings, which are incorporated in and form a part of the specification, illustrate various embodiments of the invention and, together with the description, serve to explain the structure and principles of the invention. In the drawings.

DETAILED DESCRIPTION OF THE PREFERRED EMBODIMENTS

Figure 1:
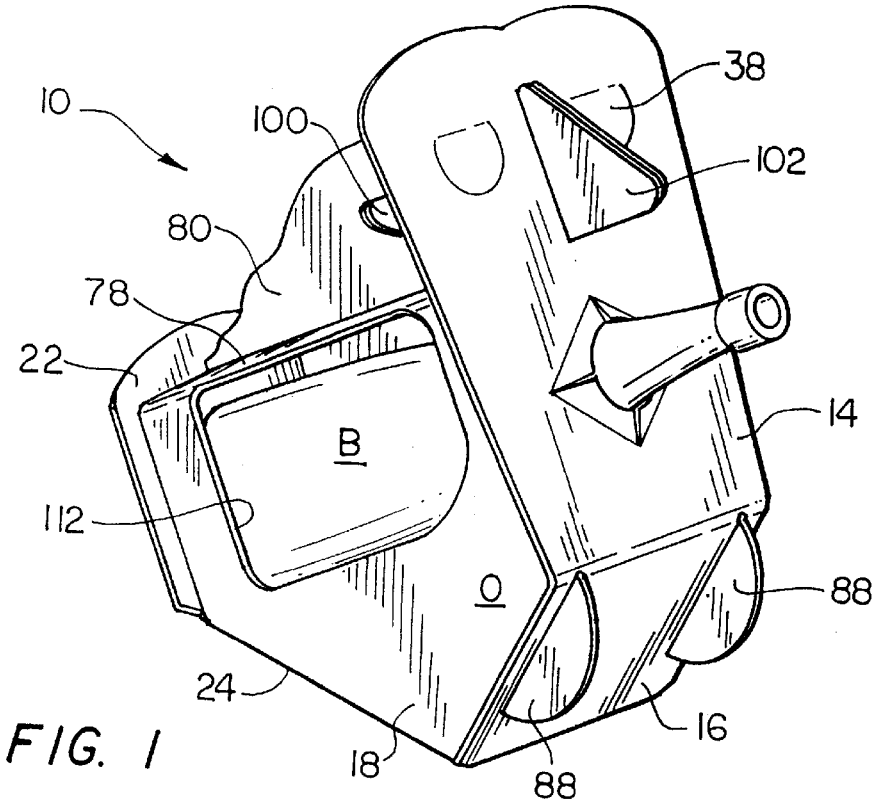
FIG. 1 is a left perspective view of the holder of the present invention.
Figure 2:
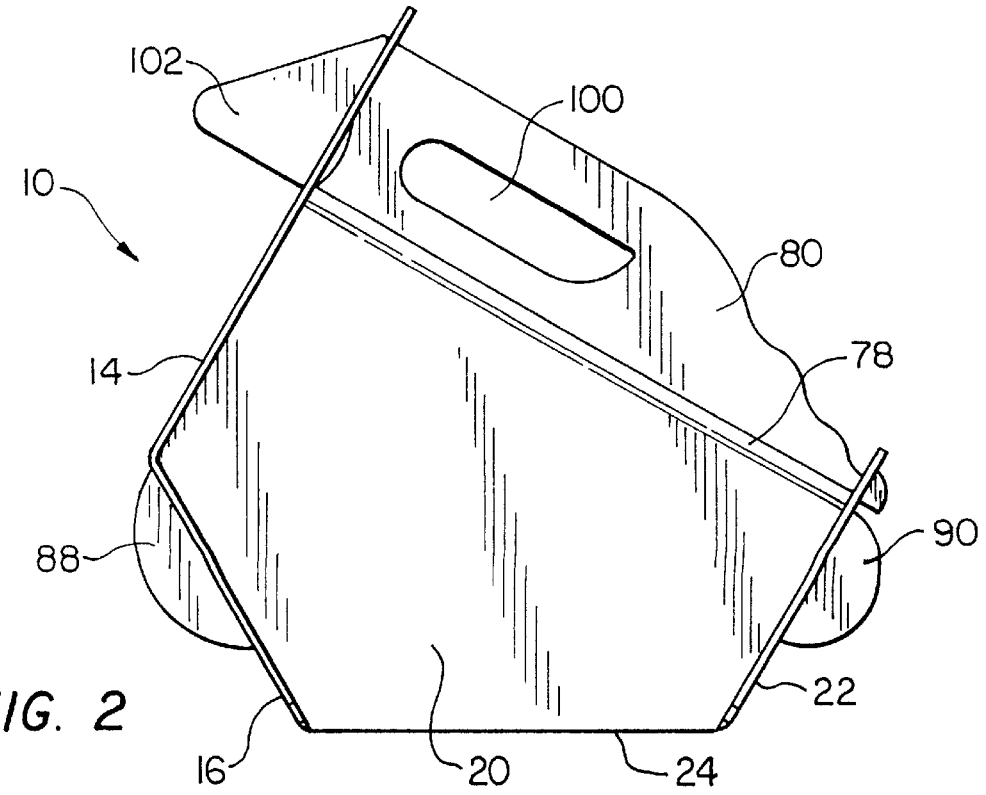
FIG. 2 is a right side elevational view thereof.
Figure 4:
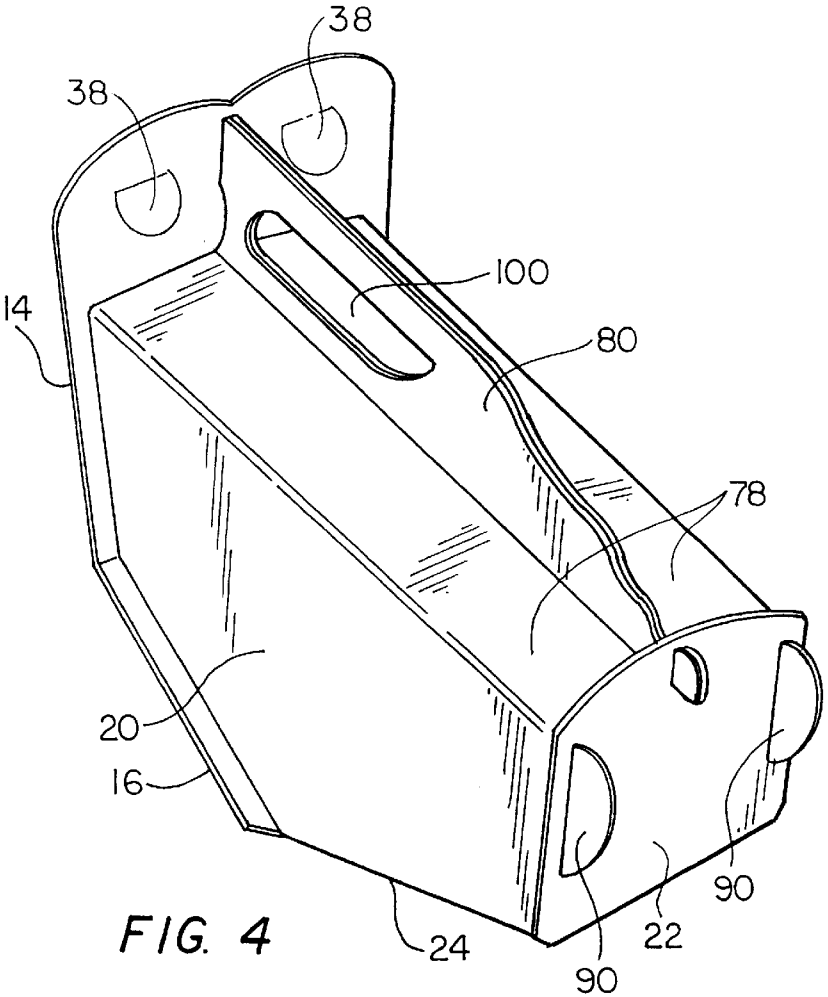
FIG. 4 is a rear perspective view thereof.
Figure 3:
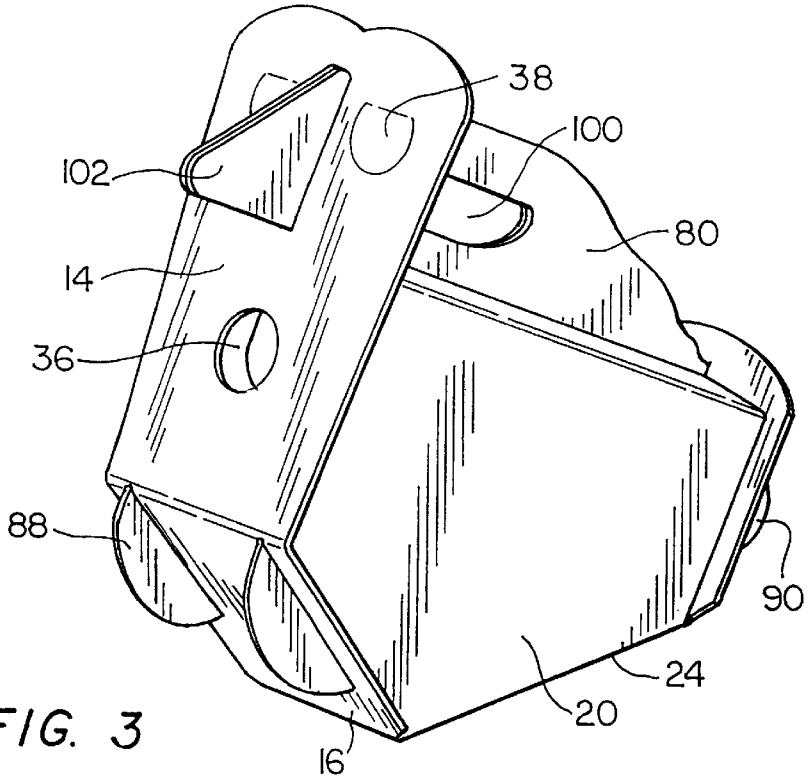
FIG. 3 is a right perspective view thereof.
Figure 5:
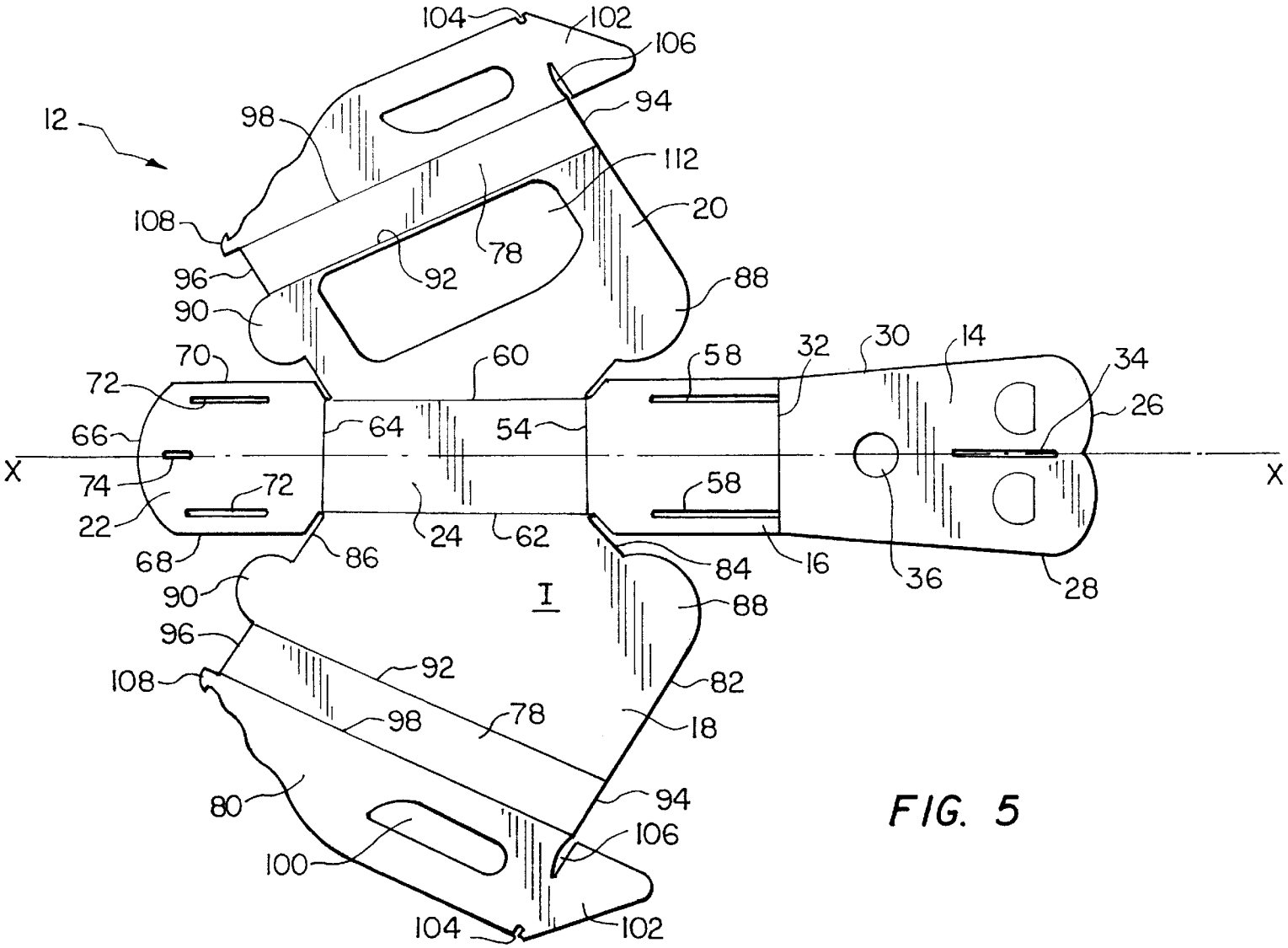
FIG. 5 is a top plan view of a blank used to form the holder of the present invention.

With reference to the Figures in which similar reference numbers are used to indicate similar elements of the invention, a holder for a bottled beverage B is shown generally at 10 in FIG. 1. While the holder will be described for use with a bottle of wine, it should be understood that the holder of the present invention may be configured for use with any type of bottle having an elongated neck. Holder 10 was designed to impart an ornamental appearance. As best shown in FIG. 1, the front panel of the holder resembles a human face having a mouth, two eyes and a nose. In keeping with the objectives of the invention, the holder may be sold to the consumer in a decorated condition or it may be sold in an unornamented condition, allowing the consumer to decorate the holder in accordance with their own taste.

Holder 10 is constructed from a one-piece blank which is cut from a sheet material such as cardboard or corrugated paper. While the blank is preferably unitary, it should be understood by those skilled in the art that blank 12 may comprise several pieces which are attached at various locations. A blank 12 for forming holder 10 is shown in a top plan view in FIG. 5. Blank 12 is symmetrical about an axis X. The blank has an inner surface I and an outer surface O. When holder 12 is assembled, inner surface I is in a facing relationship with bottle B. A plurality of panels are defined by the edges and fold lines of blank 12. As shown in FIGS. 1–5, holder 10 includes an upper front panel 14, a lower front panel 16, a left side panel 18, a right side panel 20, a rear panel 22, and a bottom or base panel 24. Upper front panel 14 is defined by a leading edge 26 and two side edges 28 and 30. Leading edge 26 is scalloped to give the appearance of a hair-line at the top of the "face". Naturally, the leading edge of front panel 14 may be cut in a straight line or in any other manner. Edges 28 and 30 extend from leading edge 26 and terminate at a fold line 32. Fold line 32 is formed by scoring or pressing the blank along a line. Upper front panel 14 is provided with a center slot 34, a circular opening 36, and two flaps 38. Center slot 34 is dimensioned to receive two tabs 102 which maintain holder 10 in the assembled condition. Tabs 102, discussed in more detail below, form the "nose" of the holder's "face".

Circular opening 36 has a diameter of approximately 3 cm to accommodate the neck of a standard wine bottle (750 ml). It should be noted by those skilled in the art that the diameter of circular opening 36 may be increased or decreased to accommodate a bottle neck of any size. Four expansion slits 40 extend from the circumference of circular opening 36. Slits 40 are provided to assist in pushing the neck of bottle B through circular opening 36. Slits 40 extend from circular opening 36 in a site-like fashion. Each slit terminates at a corner of a diamond-shaped perforation 42 (FIGS. 6 and 7) which allows the sheet material surrounding opening 36 to give way as the mouth of bottle B is pushed through the opening. Circular opening 36 adds a design aspect to the invention, as it forms the "mouth" of the holder's face.

Flaps 38 form the "eyes" of the holder's face. The flaps are formed by making U-shaped cuts 44 about the sides of center slot 34. A fold line 46 allows each flap to be pushed beyond the outer surface of upper front panel 14. An additional fold line 48 is provided on each flap to further enhance the look of the eyes. While flaps 38 are provided to complete the face of holder 10, it should be understood that flaps 38 may be omitted or configured in any other manner, if desired.

Upper front panel 14 is connected to and abuts lower front panel 16 along fold line 32. Lower front panel 16 is substantially square-shaped. It is defined by edges 50, 52 and fold lines 32, 54. Two slots 58 extend from fold line 32. Slots 58 are dimensioned to receive tabs 88 which are defined by side panels 18 and 20. Tabs 88, which are discussed in more detail below, assist in maintaining holder 10 in its assembled condition.

Lower front panel 16 is connected to bottom panel 24 at fold line 54. Bottom panel 24 forms the base of holder 10 for placement on a horizontal support surface (for example, a table). The bottom panel, which is rectangular in shape, is defined by fold lines 54, 60, 62, 64.

Rear panel 22 is connected to and abuts bottom panel 24 at fold line 64. Rear panel 22 is defined by edges 66, 68, 70. Edge 66 is rounded to coordinate with the other exposed edges of the holder. Edges 68 and 70 extend from edge 66 and terminate at fold line 64. Rear panel 22 is provided with two elongated slots 72, each of which receive a tab 90. Tabs 90, discussed in more detail below, are provided to maintain holder 10 in the assembled condition. A locking slot 74 is provided along the mid-line (axis X) of rear panel 22. Locking slot 74 is dimensioned to receive two locking tabs 108 provided on the handles of the holder. The rear panel, together with the bottom panel, provides a support for the bottom of a bottle housed within the interior of holder 20. Rear panel 22 also functions as a means for gaining access to the interior of the holder to insert or remove a bottle.

A left side panel 18 is connected to and abuts bottom panel 24 at fold line 62. Left side panel 18 comprises a side section 76, a top-forming section 78, and a handle section 80. Side section 76 includes an upper front edge 82, a lower front edge 84, and a rear edge 86. A tab 88 is formed along a portion of lower front edge 84. Tab 88 is dimensioned to be received within one of slots 58 provided in lower front panel 16. Tab 88 is curved to facilitate insertion of the tab within the slot. Another tab 90 is formed along a portion of rear edge 86. Tab 90 is dimensioned to be received within one of elongated slots 72 provided in rear panel 22. Like tab 88, tab 90 is curved to facilitate insertion of the tab within the slot.

Figure 8:
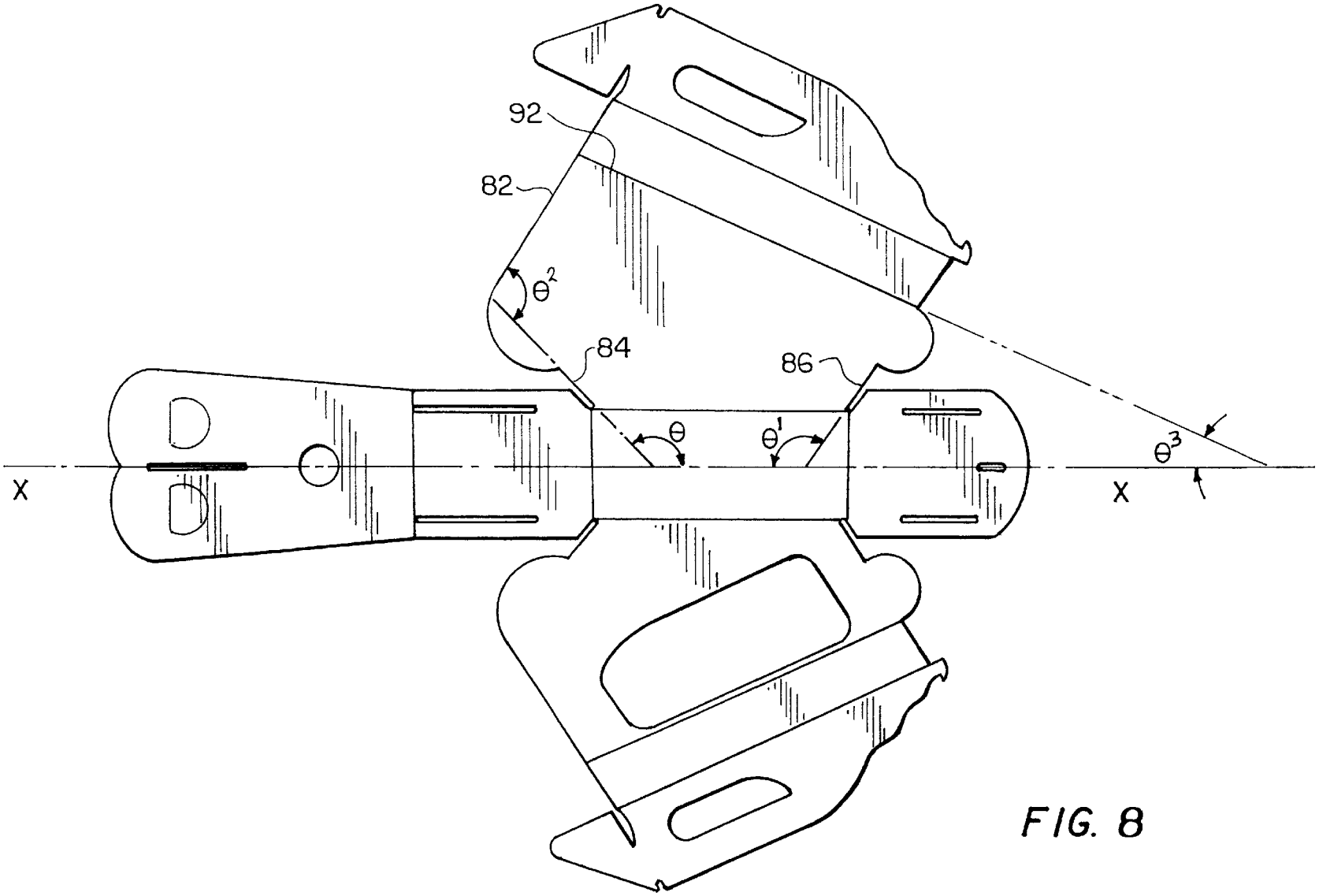
FIG. 8 is a top plan view of the blank of FIG. 5 showing the orientation of the panels.

As shown in FIG. 8, the upper front, lower front, and rear edges of side section 76 are oriented as follows:

1. Lower front edge 84 arranged at an angle $\theta$ of approximately 125° with respect to axis X.
2. Rear edge 86 arranged at an angle $\theta^1$ of approximately 120° with respect to axis X.
3. Upper front edge 82 arranged at an angle $\theta^2$ of approximately 115° with respect to lower front edge 84.

When the holder is in the assembled condition, a bottle of wine is supported within the interior of holder 10 in an inclined position (see FIG. 1). The inclined position allows the wine to oxygenate (that is, "breathe") to avoid decanting. In addition, the angled orientation of the bottle causes excess drops of wine to flow down the bottle neck for absorption by the material used to form holder 10 (for example, cardboard).

Side section 76 is connected to and abuts a top-forming section 78 at a fold line 92. Top-forming section 78 constitutes one-half of the top of holder 10. Top-forming section 78 is substantially rectangular in shape; it includes a front edge 94 and a rear edge 96. As shown in FIG. 8, fold line 92 is arranged at an angle $\theta^3$ of approximately 30° with respect to axis X.

A handle section 80 is connected to and abuts top-forming section 78 at a fold line 98. Handle section 80 defines an elongated opening 100 which functions as a handle for carrying and manipulating the holder. Opening 100 should be wide enough (for example, 9 cm) to accommodate four fingers of an adult hand. For greater comfort, the front and rear edges of opening 100 may be curved to follow the contour of the index and little fingers.

A tab 102 is provided at the front of handle section 80. Tab 102 is inserted within slot 34 to form the nose of the holder's face. Tab 102 is substantially triangular in shape. It includes an upper notch 104 and a lower notch 106 which maintain tab 102 within slot 34. A locking tab 108 is positioned at the rear of handle section 80. Locking tab 108 is of a dimension which fits within locking slot 74 of rear panel 22. Tab 108 is provided with a hooked extension 116 which "locks" the tab into slot 74 when the holder is assembled. As shown in the figures, top edge 110 of handle section 80 is scalloped to enhance the ornamental appearance of holder 10. It should be noted by those skilled in the art that the top edge of the handle may be shaped in any other manner.

Right side panel 20 is a mirror image of left side panel 18. As such, right side panel 20 comprises a side section 76, a top-forming section 78, a handle section 80 and all of the previously described parts. However, right side panel 20 may be provided with a window 112 for viewing the label of the bottle housed within holder 10 (see FIGS. 1, 5, and 8). Window 112 preferably extends from fold line 92 which connects right side section 72 to top-forming section 78. Window 112 should be of a size which allows visualization of the entire label. On the other hand, if the holder is to be used for a blind taste-testing, window 112 may be omitted or punched through a side section of the holder (by way of perforations) upon completion of the taste-testing.

Figure 6:
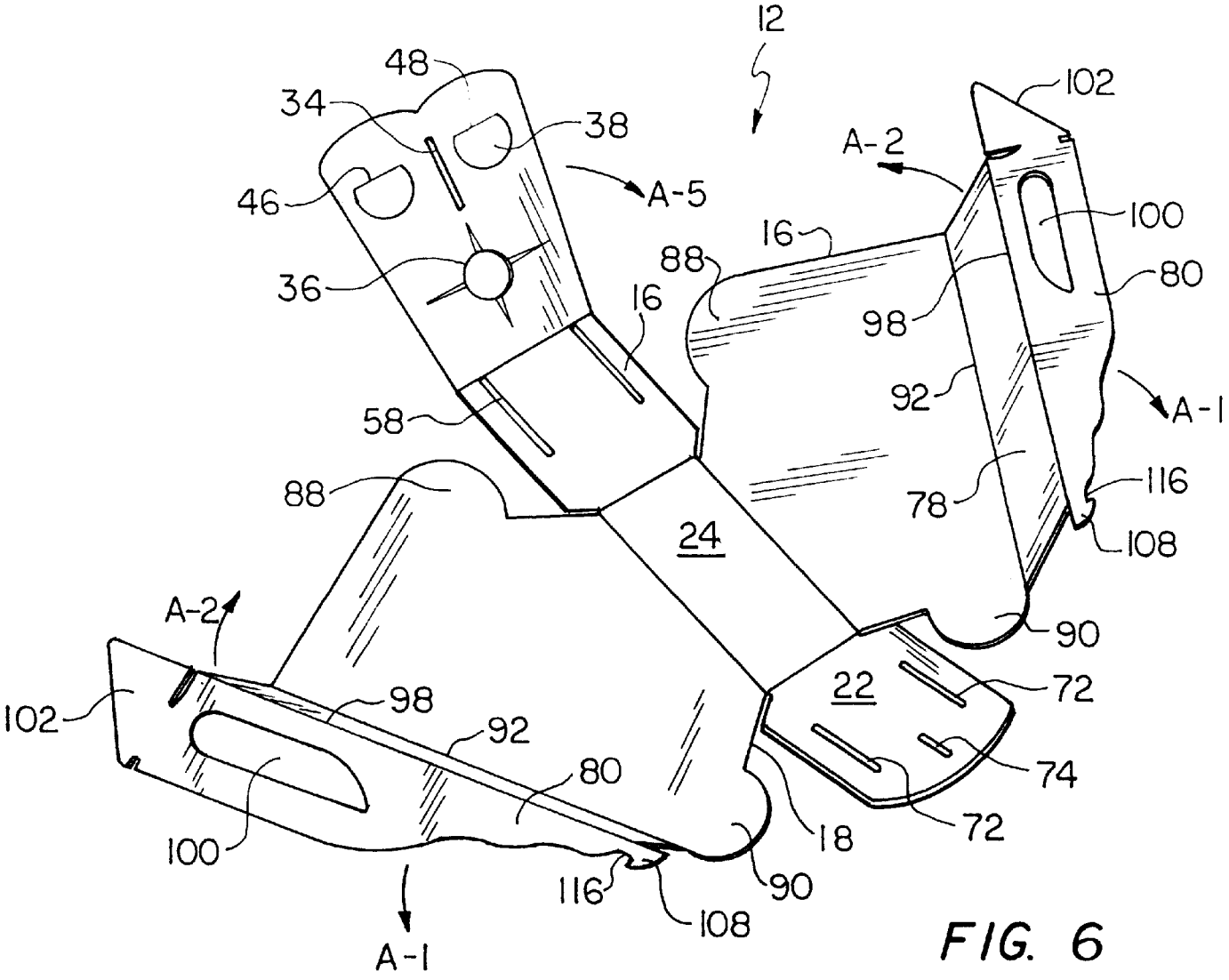
FIG. 6 is a perspective view of the blank of FIG. 5 in a partially folded condition.
Figure 7:
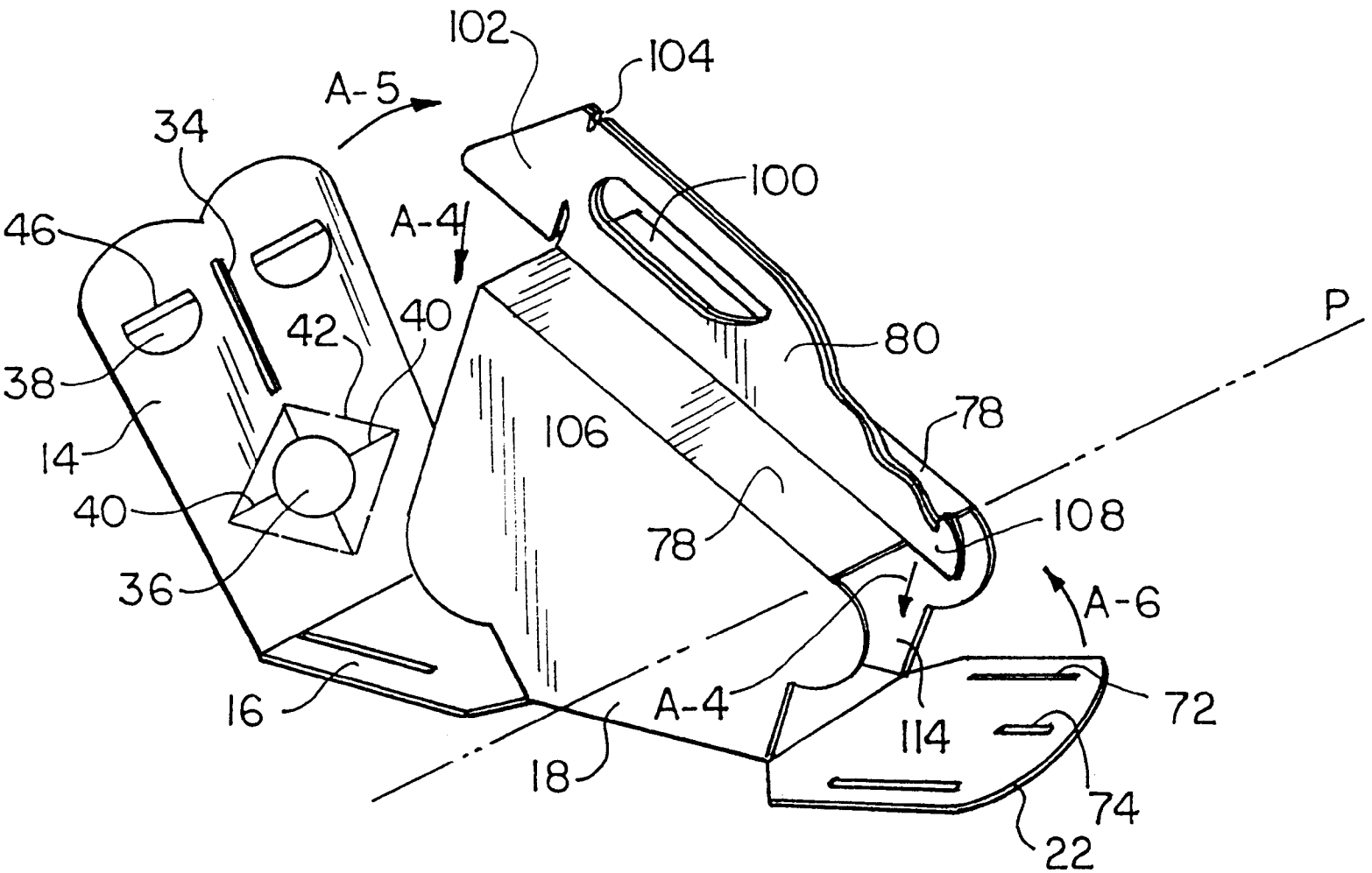
FIG. 7 is a perspective view of the blank of FIG. 5 in a further folded condition.

Having described the structure of holder 10, assembly of the holder will now be described. FIG. 6 shows blank 12 in a substantially flat condition. Holder 10 is assembled by first folding blank 12 at fold lines 32, 54, 60, 62, 64, 92, and 98. After folding the blank at all fold lines, handle section 80 of left side panel 18 and right side panel 20 is folded toward the underside of the blank 12 as shown by arrows A-1. After folding the handle sections of the holder, left and right side panels 18, 20 are folded in toward the center of holder 10 as shown by arrows A-2. The side panels are in their proper position when they are oriented at an angle of 90° with respect to bottom panel 24. Openings 100 of handles 80 are then grasped with one hand and pushed in a downward direction until top-forming sections 78 lie within a single plane P (see arrow A-4 of FIG. 7). At this point, lower front panel 16 is folded up and tabs 88 of left and right side sections 76 are inserted within their respective slots 58 of lower front panel 16. Upper front panel 14 is then folded in the direction of arrow A-5 so that tabs 102 may be positioned within slot 34 of upper front panel 14. If the holder is provided with flaps 38, they should be folded at fold lines 46, 48 and pushed beyond outer surface O of holder 10 prior to locking upper front panel 14 into place. The neck of a bottle is then inserted into opening 114 formed by top-forming sections 78, left and right side panels 18, 20 and bottom panel 24. The bottle is pushed through the interior of holder 10 until the neck of the bottle extends through circular opening 36 and the bottom of bottle B is within the periphery of opening 114. Rear panel 22 is then folded up in the direction of arrow A-6. As the rear panel comes into contact with the remainder of holder 10, tabs 90 are inserted within respective slots 72 and locking tabs 108 are positioned within locking slot 74. When holder 10 is fully assembled, a bottle of wine is securely maintained within the interior of the holder. The holder may be used as a carrier for transporting the bottle from one location to another, as a serving implement, and as a decorative package for presenting a bottle of wine as a gift. The inclined position of the bottle within the holder allows the wine to breathe, avoiding the need to decant the wine. In addition, the holder prevents light from filtering through the bottle which could damage the taste or color of the wine.

While specific angles have been described above, it should be noted by those skilled in the art that the front panel of the holder may be a single panel (as opposed to a lower front panel and an upper front panel) which may be oriented at angles other than those disclosed in this application.

As mentioned above, holder 10 is constructed from a sheet material such as cardboard or corrugated paper. The holder is preferably formed from cardboard which is, by nature, an excellent insulator. In an alternative embodiment of the invention, inner surface I of blank 12 may be provided with a thin layer of styrofoam to assist in maintaining the wine or other beverage at a desired serving temperature. If the holder is provided with a layer of styrofoam, it should be thin enough to avoid interfering with the folding of blank 12. In yet another embodiment of the invention, inner surface I of blank 12 may be provided with a wax coating to prevent condensation (which may form on a bottle of chilled wine, for example) from saturating the panels of holder 10.

Cardboard is also suitable for constructing the holder of the present invention because it is highly absorbent. As such, drops of wine which run down the neck of the bottle will be absorbed by the upper front panel of holder 10.

As mentioned above, it is envisioned that the holder of the present invention may be decorated or personalized by the consumer for presentation as a gift. Cardboard may be easily decorated with numerous craft items (for example, paints, papers, foils, fabrics, beads, etc). Alternatively, the outer surface of the holder may be printed with a design or message for presentation as a business gift. It is also possible to present the holder in its untreated condition.

While cardboard has been described as the preferred material, it should be realized by those skilled in the art that any other material which exhibits the previously mentioned properties is suitable for constructing the holder of the present invention. Regardless of the material used to form blank 12, the holder of the present invention offers a creatively distinctive way to present and serve a bottled beverage.

The preferred embodiment was chosen and described to explain the present invention to enable others skilled in the art to best utilize the invention in various embodiment and with various modifications as are suited for the particular use contemplated. It is intended that the scope of the invention be defined by the claims appended hereto.

What is claimed is:

1. A holder for a bottled beverage, comprising:

a bottom panel configured to rest on a substantially horizontal supporting surface;

a left side panel connected to said bottom panel;

a right side panel connected to said bottom panel;

a top panel having a left edge and a right edge, said left edge of said top panel being connected to said left side panel and said right edge of said top panel being connected to said right side panel;

a rear panel connected to said bottom panel;

a front panel, said front panel comprising a lower front panel connected to said bottom panel and an upper front panel connected to said lower front panel, said upper front panel comprising means dimensioned to receive a neck of the bottled beverage; and a handle adapted to receive fingers of a user, said handle being connected to said top panel and arranged perpendicularly to said front panel and said top panel;

wherein said lower front panel is arranged at a first angle with respect to said bottom panel and said upper front panel is arranged at a second angle with respect to said bottom panel different from said first angle.

2. The holder of claim 1, wherein said means comprises a circular aperture.

3. The holder of claim 1, wherein said holder is formed from a sheet material having insulating properties.

4. The holder of claim 3, wherein said material is cardboard.

5. The holder of claim 1, wherein said holder is provided with means for maintaining the holder in an assembled condition.

6. The holder of claim 5, wherein said means comprises tabs and slots.

7. The holder of claim 1, wherein said upper front panel is arranged at an angle of less than 90° with respect to said bottom panel.

8. A holder for a bottled beverage, comprising:

a bottom panel configured to rest on a substantially horizontal supporting surface;

a front panel connected to said bottom panel, said front panel comprising an aperture dimensioned to receive a neck of the bottled beverage;

a rear panel connected to said bottom panel;

a five-sided left side panel connected to said bottom panel;

a five-sided right side panel connected to said bottom panel; and a top panel connected to said left side and said right side panels;

wherein said top panel extends downwardly from said front panel to said rear panel of the holder.

9. The holder of claim 8, wherein said front panel comprises a lower portion and an upper portion and said lower portion is arranged at an angle greater than 90° with respect to said bottom panel.

10. The holder of claim 9, wherein said upper portion of said front panel is arranged at an angle of less than 90° with respect to said bottom panel.

11. The holder of claim 8, wherein said holder is formed from a sheet material having insulating properties.

12. The holder of claim 11, wherein said sheet material is cardboard.

13. The holder of claim 8 further comprising a handle connected to said top panel.

14. The holder of claim 13, wherein said handle is arranged perpendicular to said top panel and said front panel.

15. The holder of claim 9, wherein said aperture is defined by said upper portion of said front panel.

* * * * *